US008252123B2

(12) United States Patent
Nagata et al.

(10) Patent No.: US 8,252,123 B2
(45) **Date of Patent: *Aug. 28, 2012**

(54) RARE EARTH PERMANENT MAGNET AND ITS PREPARATION

(75) Inventors: Hiroaki Nagata, Echizen (JP); Tadao Nomura, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/913,165

(22) Filed: Oct. 27, 2010

(65) Prior Publication Data

US 2011/0036457 A1 Feb. 17, 2011

Related U.S. Application Data

(62) Division of application No. 12/049,603, filed on Mar. 17, 2008.

(30) Foreign Application Priority Data

Mar. 16, 2007 (JP) ..... 2007-068803
Mar. 16, 2007 (JP) ..... 2007-068823

(51) Int. Cl.
*H01F 1/057* (2006.01)

(52) U.S. Cl. ..... 148/101; 148/103; 148/122; 148/302

(58) Field of Classification Search ..... None
See application file for complete search history.

(56) References Cited

U.S. PATENT DOCUMENTS

| | | | | |
|---|---|---|---|---|
| 5,034,146 | A | 7/1991 | Ohashi et al. | |
| 5,405,455 | A | 4/1995 | Kusunoki et al. | |
| 5,595,608 | A * | 1/1997 | Takebuchi et al. | 148/104 |
| 6,376,089 | B1 | 4/2002 | Nishiuchi et al. | |
| 6,468,365 | B1 * | 10/2002 | Uchida et al. | 148/302 |
| 2002/0003006 | A1 * | 1/2002 | Nishimoto et al. | 148/102 |
| 2006/0278517 | A1 | 12/2006 | Machida et al. | |
| 2007/0034299 | A1 | 2/2007 | Machida et al. | |
| 2007/0240789 | A1 | 10/2007 | Nakamura et al. | |
| 2008/0006345 | A1 * | 1/2008 | Machida et al. | 148/120 |
| 2008/0245442 | A1 | 10/2008 | Nakamura et al. | |
| 2008/0257716 | A1 * | 10/2008 | Nagata et al. | 204/192.12 |
| 2008/0286595 | A1 * | 11/2008 | Yoshimura et al. | 428/548 |
| 2009/0020193 | A1 * | 1/2009 | Ohta et al. | 148/559 |
| 2009/0226339 | A1 | 9/2009 | Nakamura et al. | |

FOREIGN PATENT DOCUMENTS

| | | | |
|---|---|---|---|
| EP | 0255939 | A2 | 2/1988 |
| JP | 62-192566 | A | 8/1987 |
| JP | 62-256412 | A | 11/1987 |
| JP | 1-155603 | A | 6/1989 |
| JP | 5-021218 | A | 1/1993 |
| JP | 5031807 | A | 2/1993 |
| JP | 5-31807 | B2 | 5/1993 |
| JP | 2001-143949 | A | 5/2001 |
| JP | 2002-129351 | A | 5/2002 |
| JP | 2004-296973 | A | 10/2004 |
| JP | 2004-304038 | A | 10/2004 |
| JP | 2005-011973 | A | 1/2005 |
| WO | 2006/043348 | A1 | 4/2006 |
| WO | WO 2006/112403 | * | 10/2006 |

OTHER PUBLICATIONS

English Translation of Japanese Patent Document No. 02-192566.*
K. D. Durst et al.; "The Coercive Field of Sintered and Melt-Spun NdFeB Magnets"; Journal of Magnetism and Magnetic Materials, Feb. 1987, 63-75, vol. 68.
Japanese Office Action dated Jul. 8, 2009, issued in corresponding Japanese Patent Application No. 2007-068823.
K. Machida et al. "Grain Boundary Modification of Nd-Fe-B Sintered Magnet and Magnetic Properties"; Proceedings of the 2004 Spring Meeting of the Japan Society of Powder and Powder Metallurgy 2004, p. 202.
K. T. Park et al.; "Effect of Metal-Coating and Consecutive Heat Treatment on Coercivity of Thin Nd-Fe-B Sintered Magnets"; Proceedings of the Sixteenth International Workshop on Rare-Earth Magnets and Their Applications, Sendai, 2000, p. 257-264.
European Search Report dated Jun. 26, 2008, issued in corresponding European Patent Application No. 08250927.4.
C-D Qin et al., "The protective coatings of NdFeB magnets by Al and Al(Fe)", Journal of Applied Physics, American Institute of Physics, Apr. 15, 1996, pp. 4854-4856, vol. 79, No. 8.
English Translation of Japanese Patent Document No. 62-192566, Aug. 24, 1987.
Japanese Office Action dated Aug. 31, 2011, issued in corresponding Japanese Patent Application No. 2008-058987.

* cited by examiner

*Primary Examiner* — John Sheehan
(74) *Attorney, Agent, or Firm* — Westerman, Hattori, Daniels & Adrian, LLP

(57) ABSTRACT

A rare earth permanent magnet is prepared by disposing a powdered metal alloy containing at least 70 vol % of an intermetallic compound phase on a sintered body of R—Fe—B system, and heating the sintered body having the powder disposed on its surface below the sintering temperature of the sintered body in vacuum or in an inert gas for diffusion treatment. The advantages include efficient productivity, excellent magnetic performance, a minimal or zero amount of Tb or Dy used, an increased coercive force, and a minimized decline of remanence.

8 Claims, No Drawings

RARE EARTH PERMANENT MAGNET AND ITS PREPARATION

CROSS-REFERENCE TO RELATED APPLICATION

This application is a divisional of U.S. application Ser. No. 12/049,603, filed on Mar. 17, 2008 which is based upon and claims the benefit of priority under 35 U.S.C. §119(a) on Patent Application Nos. 2007-068803 and 2007-068823 filed in Japan on Mar. 16, 2007 and Mar. 16, 2007, respectively, the entire contents of which are hereby incorporated by reference.

TECHNICAL FIELD

This invention relates to an R—Fe—B permanent magnet in which an intermetallic compound is combined with a sintered magnet body so as to enhance its coercive force while minimizing a decline of its remanence, and a method for preparing the same.

BACKGROUND ART

By virtue of excellent magnetic properties, Nd—Fe—B permanent magnets find an ever increasing range of application. The recent challenge to the environmental problem has expanded the application range of these magnets from household electric appliances to industrial equipment, electric automobiles and wind power generators. It is required to further improve the performance of Nd—Fe—B magnets.

Indexes for the performance of magnets include remanence (or residual magnetic flux density) and coercive force. An increase in the remanence of Nd—Fe—B sintered magnets can be achieved by increasing the volume factor of $Nd_2Fe_{14}B$ compound and improving the crystal orientation. To this end, a number of modifications have been made. For increasing coercive force, there are known different approaches including grain refinement, the use of alloy compositions with greater Nd contents, and the addition of coercivity enhancing elements such as Al and Ga. The currently most common approach is to use alloy compositions having Dy or Tb substituted for part of Nd.

It is believed that the coercivity creating mechanism of Nd—Fe—B magnets is the nucleation type wherein nucleation of reverse magnetic domains at grain boundaries governs a coercive force. In general, a disorder of crystalline structure occurs at the grain boundary or interface. If a disorder of crystalline structure extends several nanometers in a depth direction near the interface of grains of $Nd_2Fe_{14}B$ compound which is the primary phase of the magnet, then it incurs a lowering of magnetocrystalline anisotropy and facilitates formation of reverse magnetic domains, reducing a coercive force (see K. D. Durst and H. Kronmuller, "THE COERCIVE FIELD OF SINTERED AND MELT-SPUN NdFeB MAGNETS," Journal of Magnetism and Magnetic Materials, 68 (1987), 63-75). Substituting Dy or Tb for some Nd in the $Nd_2Fe_{14}B$ compound increases the anisotropic magnetic field of the compound phase so that the coercive force is increased. When Dy or Tb is added in an ordinary way, however, a loss of remanence is unavoidable because Dy or Tb substitution occurs not only near the interface of the primary phase, but even in the interior of the primary phase. Another problem arises in that amounts of expensive Tb and Dy must be used.

Besides, a number of attempts have been made for increasing the coercive force of Nd—Fe—B magnets. One exemplary attempt is a two-alloy method of preparing an Nd—Fe—B magnet by mixing two powdered alloys of different composition and sintering the mixture. A powder of alloy A consists of $R_2Fe_{14}B$ primary phase wherein R is mainly Nd and Pr. And a powder of alloy B contains various additive elements including Dy, Tb, Ho, Er, Al, Ti, V, and Mo, typically Dy and Tb. Then alloys A and B are mixed together. This is followed by fine pulverization, pressing in a magnetic field, sintering, and aging treatment whereby the Nd—Fe—B magnet is prepared. The sintered magnet thus obtained produces a high coercive force while minimizing a decline of remanence because Dy or Tb is absent at the center of $R_2Fe_{14}B$ compound primary phase grains and instead, the additive elements like Dy and Tb are localized near grain boundaries (see JP-B 5-31807 and JP-A 5-21218). In this method, however, Dy or Tb diffuses into the interior of primary phase grains during the sintering so that the layer where Dy or Tb is localized near grain boundaries has a thickness equal to or more than about 1 micrometer, which is to substantially greater than the depth where nucleation of reverse magnetic domains occurs. The results are still not fully satisfactory.

Recently, there have been developed several processes of diffusing certain elements from the surface to the interior of a R—Fe—B sintered body for improving magnet properties. In one exemplary process, a rare earth metal such as Yb, Dy, Pr or Tb, or Al or Ta is deposited on the surface of Nd—Fe—B magnet using an evaporation or sputtering technique, followed by heat treatment. See JP-A 2004-296973, JP-A 2004-304038, JP-A 2005-11973; K. T. Park, K. Hiraga and M. Sagawa, "Effect of Metal-Coating and Consecutive Heat Treatment on Coercivity of Thin Nd—Fe—B Sintered Magnets," Proceedings of the 16th International Workshop on Rare-Earth Magnets and Their Applications, Sendai, p. 257 (2000); and K. Machida, at al., "Grain Boundary Modification of Nd—Fe—B Sintered Magnet and Magnetic Properties," Abstracts of Spring Meeting of Japan Society of Powder and Powder Metallurgy, 2004, p. 202. Another exemplary process involves applying a powder of rare earth inorganic compound such as fluoride or oxide onto the surface of a sintered body and heat treatment as described in WO 2006/043348 A1. With these processes, the element (e.g., Dy or Tb) disposed on the sintered body surface pass through grain boundaries in the sintered body structure and diffuse into the interior of the sintered body during the heat treatment. As a consequence, Dy or Tb can be enriched in a very high concentration at grain boundaries or near grain boundaries within sintered body primary phase grains. As compared with the two-alloy method described previously, these processes produce an ideal morphology. Since the magnet properties reflect the morphology, a minimized decline of remanence and an increase of coercive force are accomplished. However, the processes utilizing evaporation or sputtering have many problems associated with units and steps when practiced on a mass scale and suffer from poor productivity.

DISCLOSURE OF THE INVENTION

An object of the invention is to provide an R—Fe—B sintered magnet which is prepared by applying an intermetallic compound-based alloy powder onto a sintered body and effecting diffusion treatment and which magnet features efficient productivity, excellent magnetic performance, a minimal or zero amount of Tb or Dy used, an increased coercive force, and a minimized decline of remanence. Another object is to provide a method for preparing the same.

The inventors have discovered that when an R—Fe—B sintered body is tailored by applying to a surface thereof an alloy powder based on an easily pulverizable intermetallic compound phase and effecting diffusion treatment, the process is improved in productivity over the prior art processes, and constituent elements of the diffusion alloy are enriched near the interface of primary phase grains within the sintered body so that the coercive force is increased while minimizing a decline of remanence. The invention is predicated on this discovery.

The invention provides rare earth permanent magnets and methods for preparing the same, as defined below.

[1] A method for preparing a rare earth permanent magnet, comprising the steps of:

disposing an alloy powder on a surface of a sintered body of the composition $R_a$-$T^1_b$-$B_c$ wherein R is at least one element selected from rare earth elements inclusive of Y and Sc, $T^1$ is at least one element selected from Fe and Co, B is boron, "a," "b" and "c" indicative of atomic percent are in the range: $12 \leqq a \leqq 20$, $4.0 \leqq c \leqq 7.0$, and the balance of b, said alloy powder having the composition $R^1_i$-$M^1_j$ wherein $R^1$ is at least one element selected from rare earth elements inclusive of Y and Sc, $M^1$ is at least one element selected from the group consisting of Al, Si, C, P, Ti, V, Cr, Mn, Ni, Cu, Zn, Ga, Ge, Zr, Nb, Mo, Ag, In, Sn, Sb, Hf, Ta, W, Pb, and Bi, "i" and "j" indicative of atomic percent are in the range: $15<j \leqq 99$ and the balance of i, and containing at least 70% by volume of an intermetallic compound phase, and heat treating the sintered body having the powder disposed on its surface at a temperature equal to or below the sintering temperature of the sintered body in vacuum or in an inert gas, for causing at least one element of $R^1$ and $M^1$ in the powder to diffuse to grain boundaries in the interior of the sintered body and/or near grain boundaries within sintered body primary phase grains.

[2] The method of [1] wherein the disposing step includes grinding an alloy having the composition $R^1_i$-$M^1_j$ wherein $R^1$, $M^1$, i and j are as defined above and containing at least 70% by volume of an intermetallic compound phase into a powder having an average particle size of up to 500 μm, dispersing the powder in an organic solvent or water, applying the resulting slurry to the surface of the sintered body, and drying.

[3] The method of [1] or [2] wherein the heat treating step includes heat treatment at a temperature from 200° C. to (Ts-10)° C. for 1 minute to 30 hours wherein Ts represents the sintering temperature of the sintered body.

[4] The method of [1], [2] or [3] wherein the sintered body has a shape including a minimum portion with a dimension equal to or less than 20 mm.

[5] A method for preparing a rare earth permanent magnet, comprising the steps of:

disposing an alloy powder on a surface of a sintered body of the composition $R_a$-$T^1_b$-$B_c$ wherein R is at least one element selected from rare earth elements inclusive of Y and Sc, $T^1$ is at least one element selected from Fe and Co, B is boron, "a," "b" and "c" indicative of atomic percent are in the range: $12 \leqq a \leqq 20$, $4.0 \leqq c \leqq 7.0$, and the balance of b, said alloy powder having the composition $R^1_xT^2_yM^1_z$ wherein $R^1$ is at least one element selected from rare earth elements inclusive of Y and Sc, $T^2$ is at least one element selected from Fe and Co, $M^1$ is at least one element selected from the group consisting of Al, Si, C, P, Ti, V, Cr, Mn, Ni, Cu, Zn, Ga, Ge, Zr, Nb, Mo, Ag, In, Sn, Sb, Hf, Ta, W, Pb, and Bi, x, y and z indicative of atomic percent are in the range: $5 \leqq x \leqq 85$, $15<z \leqq 95$, and the balance of y which is greater than 0, and containing at least 70% by volume of an intermetallic compound phase, and heat treating the sintered body having the powder disposed on its surface at a temperature equal to or below the sintering temperature of the sintered body in vacuum or in an inert gas, for causing at least one element of $R^1$ and $M^1$ in the powder to diffuse to grain boundaries in the interior of the sintered body and/or near grain boundaries within sintered body primary phase grains.

[6] The method of [5] wherein the disposing step includes grinding an alloy having the composition $R^1_xT^2_yM^1_z$ wherein $R^1$, $T^2$, $M^1$, x, y and z are as defined above and containing at least 70% by volume of an intermetallic compound phase into a powder having an average particle size of up to 500 μm, dispersing the powder in an organic solvent or water, applying the resulting slurry to the surface of the sintered body, and drying.

[7] The method of [5] or [6] wherein the heat treating step includes heat treatment at a temperature from 200° C. to (Ts-10)° C. for 1 minute to 30 hours wherein Ts represents the sintering temperature of the sintered body.

[8] The method of [5], [6] or [7] wherein the sintered body has a shape including a minimum portion with a dimension equal to or less than 20 mm.

[9] A rare earth permanent magnet, which is prepared by disposing an alloy powder on a surface of a sintered body of the composition $R_a$-$T^1_b$-$B_c$ wherein R is at least one element selected from rare earth elements inclusive of Y and Sc, $T^1$ is at least one element selected from Fe and Co, B is boron, "a," "b" and "c" indicative of atomic percent are in the range: $12 \leqq a \leqq 20$, $4.0 \leqq c \leqq 7.0$, and the balance of b, said alloy powder having the composition $R^1_i$-$M^1_j$ wherein $R^1$ is at least one element selected from rare earth elements inclusive of Y and Sc, $M^1$ is at least one element selected from the group consisting of Al, Si, C, P, Ti, V, Cr, Mn, Ni, Cu, Zn, Ga, Ge, Zr, Nb, Mo, Ag, In, Sn, Sb, Hf, Ta, W, Pb, and Bi, "i" and "j" indicative of atomic percent are in the range: $15<j \leqq 99$ and the balance of i, and containing at least 70% by volume of an intermetallic compound phase, and heat treating the sintered body having the powder disposed on its surface at a temperature equal to or below the sintering temperature of the sintered body in vacuum or in an inert gas, wherein at least one element of $R^1$ and $M^1$ in the powder is diffused to grain boundaries in the interior of the sintered body and/or near grain boundaries within sintered body primary phase grains so that the coercive force of the magnet is increased over the magnet properties of the original sintered body.

[10] A rare earth permanent magnet, which is prepared by disposing an alloy powder on a surface of a sintered body of the composition $R_a$-$T^1_b$-$B_c$ wherein R is at least one element selected from rare earth elements inclusive of Y and Sc, $T^1$ is at least one element selected from Fe and Co, B is boron, "a," "b" and "c" indicative of atomic percent are in the range: $12 \leqq a \leqq 20$, $4.0 \leqq c \leqq 7.0$, and the balance of b, said alloy powder having the composition $R^1_xT^2_yM^1_z$ wherein $R^1$ is at least one element selected from rare earth elements inclusive of Y and Sc, $T^2$ is at least one element selected from Fe and Co, $M^1$ is at least one element selected from the group consisting of Al, Si, C, P, Ti, V, Cr, Mn, Ni, Cu, Zn, Ga, Ge, Zr, Nb, Mo, Ag, In, Sn, Sb, Hf, Ta, W, Pb, and Bi, x, y and z indicative of atomic percent are in the range: $5 \leqq x \leqq 85$, $15<z \leqq 95$, and the balance of y which is greater than 0, and containing at least 70% by volume of an intermetallic compound phase, and heat treating the sintered body having the powder disposed on its surface at a temperature equal to or below the sintering temperature of the sintered body in vacuum or in an inert gas, wherein at least one element of $R^1$ and $M^1$ in the powder is diffused to grain boundaries in the interior of the sintered body and/or near grain boundaries within sintered body primary phase grains so that the coercive force of the magnet is increased over the magnet properties of the original sintered body.

[11] A method for preparing a rare earth permanent magnet, comprising the steps of:

disposing an alloy powder on a surface of a sintered body of the composition $R_a$-$T^1{}_b$-$B_c$ wherein R is at least one element selected from rare earth elements inclusive of Y and Sc, $T^1$ is at least one element selected from Fe and Co, B is boron, "a," "b" and "c" indicative of atomic percent are in the range: $12 \leqq a \leqq 20$, $4.0 \leqq c \leqq 7.0$, and the balance of b, said alloy powder having the composition $M^1{}_d$-$M^2{}_e$ wherein each of $M^1$ and $M^2$ is at least one element selected from the group consisting of Al, Si, C, P, Ti, V, Cr, Mn, Fe, Co, Ni, Cu, Zn, Ga, Ge, Zr, Nb, Mo, Ag, In, Sn, Sb, Hf, Ta, W, Pb, and Bi, $M^1$ is different from $M^2$, "d" and "e" indicative of atomic percent are in the range: $0.1 \leqq e \leqq 99.9$ and the balance of d, and containing at least 70% by volume of an intermetallic compound phase, and heat treating the sintered body having the powder disposed on its surface at a temperature equal to or below the sintering temperature of the sintered body in vacuum or in an inert gas, for causing at least one element of $M^1$ and $M^2$ in the powder to diffuse to grain boundaries in the interior of the sintered body and/or near grain boundaries within sintered body primary phase grains.

[12] The method of [11] wherein the disposing step includes grinding an alloy having the composition $M^1{}_d$-$M^2{}_e$ wherein $M^1$, $M^2$, d and e are as defined above and containing at least 70% by volume of an intermetallic compound phase into a powder having an average particle size of up to 500 μm, dispersing the powder in an organic solvent or water, applying the resulting slurry to the surface of the sintered body, and drying.

[13] The method of [11] or [12] wherein the heat treating step includes heat treatment at a temperature from 200° C. to (Ts-10)° C. for 1 minute to 30 hours wherein Ts represents the sintering temperature of the sintered body.

[14] The method of [11], [12] or [13] wherein the sintered body has a shape including a minimum portion with a dimension equal to or less than 20 mm.

[15] A rare earth permanent magnet, which is prepared by disposing an alloy powder on a surface of a sintered body of the composition $R_a$-$T^1{}_b$-$B_c$ wherein R is at least one element selected from rare earth elements inclusive of Y and Sc, $T^1$ is at least one element selected from Fe and Co, B is boron, "a," "b" and "c" indicative of atomic percent are in the range: $12 \leqq a \leqq 20$, $4.0 \leqq c \leqq 7.0$, and the balance of b, said alloy powder having the composition $M^1{}_d$-$M^2{}_e$ wherein each of $M^1$ and $M^2$ is at least one element selected from the group consisting of Al, Si, C, P, Ti, V, Cr, Mn, Fe, Co, Ni, Cu, Zn, Ga, Ge, Zr, Nb, Mo, Ag, In, Sn, Sb, Hf, Ta, W, Pb, and Bi, $M^1$ is different from $M^2$, "d" and "e" indicative of atomic percent are in the range: $0.1 \leqq e \leqq 99.9$ and the balance of d, and containing at least 70% by volume of an intermetallic compound phase, and heat treating the sintered body having the powder disposed on its surface at a temperature equal to or below the sintering temperature of the sintered body in vacuum or in an inert gas, wherein at least one element of $M^1$ and $M^2$ in the powder is diffused to grain boundaries in the interior of the sintered body and/or near grain boundaries within sintered body primary phase grains so that the coercive force of the magnet is increased over the magnet properties of the original sintered body.

BENEFITS OF THE INVENTION

According to the invention, an R—Fe—B sintered magnet is prepared by applying an alloy powder based on an easily pulverizable intermetallic compound onto a sintered body and effecting diffusion treatment. The advantages of the resultant magnet include efficient productivity, excellent magnetic performance, a minimal or zero amount of Tb or Dy used, an increased coercive force, and a minimized decline of remanence.

DESCRIPTION OF THE PREFERRED EMBODIMENT

Briefly stated, an R—Fe—B sintered magnet is prepared according to the invention by applying an intermetallic compound-based alloy powder onto a sintered body and effecting diffusion treatment. The resultant magnet has advantages including excellent magnetic performance and a minimal amount of Tb or Dy used or the absence of Tb or Dy.

The mother material used in the invention is a sintered body of the composition $R_a$-$T^1{}_b$-$B_c$, which is often referred to as "mother sintered body." Herein R is at least one element selected from rare earth elements inclusive of scandium (Sc) and yttrium (Y), specifically from among Sc, Y, La, Ce, Pr, Nd, Sm, Eu, Gd, Tb, Dy, Ho, Er, Yb, and Lu. Preferably the majority of R is Nd and/or Pr. Preferably the rare earth elements inclusive of Sc and Y account for 12 to 20 atomic percents (at %), and more preferably 14 to 18 at % of the entire sintered body. $T^1$ is at least one element selected from iron (Fe) and cobalt (Co). B is boron, and preferably accounts for 4 to 7 at % of the entire sintered body. Particularly when B is 5 to 6 at %, a significant improvement in coercive force is achieved by diffusion treatment. The balance consists of $T^1$.

The alloy for the mother sintered body is prepared by melting metal or alloy feeds in vacuum or an inert gas atmosphere, preferably argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and a rare earth-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since primary crystal α-Fe is likely to be left depending on the cooling rate during casting and the alloy composition. The homogenizing treatment is a heat treatment at 700 to 1,200° C. for at least one hour in vacuum or in an Ar atmosphere. Alternatively, the alloy approximate to the primary phase composition may be prepared by the strip casting technique. To the rare earth-rich alloy serving as a liquid phase aid, the melt quenching and strip casting techniques are applicable as well as the above-described casting technique.

The alloy is generally crushed or coarsely ground to a size of 0.05 to 3 mm, especially 0.05 to 1.5 mm. The crushing step uses a Brown mill or hydriding pulverization, with the hydriding pulverization being preferred for those alloys as strip cast. The coarse powder is then finely pulverized to an average particle size of 0.2 to 30 μm, especially 0.5 to 20 μm, for example, on a jet mill using high-pressure nitrogen.

The fine powder is compacted on a compression molding machine under a magnetic field. The green compact is then placed in a sintering furnace where it is sintered in vacuum or in an inert gas atmosphere usually at a temperature of 900 to 1,250° C., preferably 1,000 to 1,100° C. The sintered block thus obtained contains 60 to 99% by volume, preferably 80 to 98% by volume of the tetragonal $R_2Fe_{14}B$ compound as the primary phase, with the balance being 0.5 to 20% by volume of a rare earth-rich phase and 0.1 to 10% by volume of at least one compound selected from among rare earth oxides, and carbides, nitrides and hydroxides of incidental impurities, and mixtures or composites thereof.

The resulting sintered block may be machined or worked into a predetermined shape. In the invention, $R^1$ and/or $M^1$ and $T^2$, or $M^1$ and/or $M^2$ which are to be diffused into the sintered body interior are supplied from the sintered body surface. Thus, if a minimum portion of the sintered body has too large a dimension, the objects of the invention are not achievable. For this reason, the shape includes a minimum portion having a dimension equal to or less than 20 mm, and preferably equal to or less than 10 mm, with the lower limit being equal to or more than 0.1 mm. The sintered body includes a maximum portion whose dimension is not particularly limited, with the maximum portion dimension being desirably equal to or less than 200 mm.

According to the invention, an alloy powder is disposed on the sintered body and subjected to diffusion treatment. It is a powdered alloy having the composition: $R^1_i$-$M^1_j$ or $R^1_xT^2_yM^1_z$ or $M^1_d$-$M^2_e$. This alloy is often referred to as "diffusion alloy." Herein $R^1$ is at least one element selected from rare earth elements inclusive of Y and Sc, and preferably the majority of $R^1$ is Nd and Pr. $M^1$ is at least one element selected from the group consisting of Al, Si, C, P, Ti, V, Cr, Mn, Ni, Cu, Zn, Ga, Ge, Zr, Nb, Mo, Ag, In, Sn, Sb, Hf, Ta, W, Pb, and Bi. In the alloy $M^1_d$-$M^2_e$, $M^1$ and $M^2$ are different from each other and selected from the group consisting of the foregoing elements. $T^2$ is Fe and/or Co. In the alloy $R^1_i$-$M^1_j$, $M^1$ accounts for 15 to 99 at % (i.e., j=15 to 99), with the balance being $R^1$. In the alloy $R^1_xT^2_yM^1_z$, $M^1$ accounts for 15 to 95 at % (i.e., z=15 to 95) and $R^1$ accounts for 5 to 85 at % (i.e., x=5 to 85), with the balance being $T^2$. That is, y>0, and $T^2$ is preferably 0.5 to 75 at %. In the alloy $M^1_d$-$M^2_e$, $M^2$ accounts for 0.1 to 99.9 at %, that is, e is in the range: $0.1 \leqq e \leqq 99.9$. $M^1$ is the remainder after removal of $M^2$, that is, d is the balance.

The diffusion alloy may contain incidental impurities such as nitrogen (N) and oxygen (O), with an acceptable total amount of such impurities being equal to or less than 4 at %.

The invention is characterized in that the diffusion alloy material contains at least 70% by volume of an intermetallic compound phase in its structure. If the diffusion material is composed of a single metal or eutectic alloy, it is unsusceptible to pulverization and requires a special technique such as atomizing for a fine powder. By contrast, the intermetallic compound phase is generally hard and brittle in nature. When an alloy based on such an intermetallic compound phase is used as the diffusion material, a fine powder is readily obtained simply by applying the alloy preparation or pulverization means used in the manufacture of R—Fe—B sintered magnets. This is quite advantageous from the productivity aspect. Since the diffusion alloy material is advantageously readily pulverizable, it preferably contains at least 70% by volume and more preferably at least 90% by volume of an intermetallic compound phase. It is understood that the term "% by volume" is interchangeable with a percent by area of an intermetallic compound phase in a cross-section of the alloy structure.

The diffusion alloy containing at least 70% by volume of the intermetallic compound phase represented by $R^1_i$-$M^1_j$, $R^1_xT^2_yM^1_z$ or $M^1_d$-$M^2_e$ may be prepared, like the alloy for the mother sintered body, by melting metal or alloy feeds in vacuum or an inert gas atmosphere, preferably argon atmosphere, and casting the melt into a flat mold or book mold. An arc melting or strip casting method is also acceptable. The alloy is then crushed or coarsely ground to a size of about 0.05 to 3 mm, especially about 0.05 to 1.5 mm by means of a Brown mill or hydriding pulverization. The coarse powder is then finely pulverized, for example, by a ball mill, vibration mill or jet mill using high-pressure nitrogen. The smaller the powder particle size, the higher becomes the diffusion efficiency. The diffusion alloy containing the intermetallic compound phase represented by $R^1_i$-$M^1_j$, $R^1_xT^2_yM^1_z$ or $M^1_d$-$M^2_e$, when powdered, preferably has an average particle size equal to or less than 500 μm, more preferably equal to or less than 300 μm, and even more preferably equal to or less than 100 μm. However, if the particle size is too small, then the influence of surface oxidation becomes noticeable, and handling is dangerous. Thus the lower limit of average particle size is preferably equal to or more than 1 μm. As used herein, the "average particle size" may be determined as a weight average diameter $D_{50}$ (particle diameter at 50% by weight cumulative, or median diameter) using, for example, a particle size distribution measuring instrument relying on laser diffractometry or the like.

After the powder of diffusion alloy is disposed on the surface of the mother sintered body, the mother sintered body and the diffusion alloy powder are heat treated in vacuum or in an atmosphere of an inert gas such as argon (Ar) or helium (He) at a temperature equal to or below the sintering temperature (designated Ts in ° C.) of the sintered body. This heat treatment is referred to as "diffusion treatment." By the diffusion treatment, $R^1$, $M^1$ or $M^2$ in the diffusion alloy is diffused to grain boundaries in the interior of the sintered body and/or near grain boundaries within sintered body primary phase grains.

The diffusion alloy powder is disposed on the surface of the mother sintered body, for example, by dispersing the powder in water or an organic solvent to form a slurry, immersing the sintered body in the slurry, and drying the immersed sintered body by air drying, hot air drying or in vacuum. Spray coating is also possible. The slurry may contain 1 to 90% by weight, and preferably 5 to 70% by weight of the powder.

Better results are obtained when the filling factor of the elements from the applied diffusion alloy is at least 1% by volume, preferably at least 10% by volume, calculated as an average value in a sintered body-surrounding space extending outward from the sintered body surface to a distance equal to or less than 1 mm. The upper limit of filling factor is generally equal to or less than 95% by volume, and preferably equal to or less than 90% by volume, though not critical.

The conditions of diffusion treatment vary with the type and composition of the diffusion alloy and are preferably selected such that $R^1$ and/or $M^1$ and/or $M^2$ is enriched at grain boundaries in the interior of the sintered body and/or near grain boundaries within sintered body primary phase grains. The temperature of diffusion treatment is equal to or below the sintering temperature (designated Ts in ° C.) of the sintered body. If diffusion treatment is effected above Ts, there arise problems that (1) the structure of the sintered body can be altered to degrade magnetic properties, and (2) the machined dimensions cannot be maintained due to thermal deformation. For this reason, the temperature of diffusion treatment is equal to or below Ts° C. of the sintered body, and preferably equal to or below (Ts-10)° C. The lower limit of temperature may be selected as appropriate though it is typically at least 200° C., and preferably at least 350° C. The time of diffusion treatment is typically from 1 minute to 30 hours. Within less than 1 minute, the diffusion treatment is not complete. If the treatment time is over 30 hours, the structure of the sintered body can be altered, oxidation or evaporation of components inevitably occurs to degrade magnetic properties, or $M^1$ or $M^2$ is not only enriched at grain boundaries in the interior of the sintered body and/or near grain boundaries within sintered body primary phase grains, but also diffused into the interior of primary phase grains. The preferred time of diffusion treatment is from 1 minute to 10 hours, and more preferably from 10 minutes to 6 hours.

Through appropriate diffusion treatment, the constituent element $R^1$, $M^1$ or $M^2$ of the diffusion alloy disposed on the surface of the sintered body is diffused into the sintered body while traveling mainly along grain boundaries in the sintered body structure. This results in the structure in which $R^1$, $M^1$ or $M^2$ is enriched at grain boundaries in the interior of the sintered body and/or near grain boundaries within sintered body primary phase grains.

The permanent magnet thus obtained is improved in coercivity in that the diffusion of $R^1$, $M^1$ or $M^2$ modifies the morphology near the primary phase grain boundaries within the structure so as to suppress a decline of magnetocrystalline anisotropy at primary phase grain boundaries or to create a new phase at grain boundaries. Since the diffusion alloy elements have not diffused into the interior of primary phase grains, a decline of remanence is restrained. The magnet is a high performance permanent magnet.

After the diffusion treatment, the magnet may be further subjected to aging treatment at a temperature of 200 to 900° C. for augmenting the coercivity enhancement.

EXAMPLE

Examples are given below for further illustrating the invention although the invention is not limited thereto.

Example 1 and Comparative Example 1

A magnet alloy was prepared by using Nd, Fe and Co metals having a purity of at least 99% by weight and ferroboron, high-frequency heating in an argon atmosphere for melting, and casting the alloy melt in a copper mold. The alloy was ground on a Brown mill into a coarse powder with a particle size of up to 1 mm.

Subsequently, the coarse powder was finely pulverized on a jet mill using high-pressure nitrogen gas into a fine powder having a mass median particle diameter of 5.2 μm. The fine powder was compacted under a pressure of about 300 kg/cm$^2$ while being oriented in a magnetic field of 1592 kAm$^{-1}$. The green compact was then placed in a vacuum sintering furnace where it was sintered at 1,060° C. for 1.5 hours, obtaining a sintered block. Using a diamond grinding tool, the sintered block was machined on all the surfaces into a shape having dimensions of 4×4×2 mm. It was washed in sequence with alkaline solution, deionized water, nitric acid and deionized water, and dried, obtaining a mother sintered body which had the composition $Nd_{16.0}Fe_{bal}Co_{1.0}B_{5.3}$.

By using Nd and Al metals having a purity of at least 99% by weight and arc melting in an argon atmosphere, a diffusion alloy having the composition $Nd_{33}Al_{67}$ and composed mainly of an intermetallic compound phase $NdAl_2$ was prepared. The alloy was finely pulverized on a ball mill using an organic solvent into a fine powder having a mass median particle diameter of 7.8 μm. On electron probe microanalysis (EPMA), the alloy contained 94% by volume of the intermetallic compound phase $NdAl_2$.

The diffusion alloy powder, 15 g, was mixed with 45 g of ethanol to form a slurry, in which the mother sintered body was immersed for 30 seconds under ultrasonic agitation. The sintered body was pulled up and immediately dried with hot air.

The sintered body covered with the diffusion alloy powder was subjected to diffusion treatment in vacuum at 800° C. for one hour, yielding a magnet of Example 1. In the absence of the diffusion alloy powder, the sintered body alone was subjected to heat treatment in vacuum at 800° C. for one hour, yielding a magnet of Comparative Example 1.

Table 1 summarizes the composition of the mother sintered body and the diffusion alloy, the main intermetallic compound in the diffusion alloy, the temperature and time of diffusion treatment in Example 1 and Comparative Example 1. Table 2 shows the magnetic properties of the magnets of Example 1 and Comparative Example 1. It is seen that the coercive force (Hcj) of the magnet of Example 1 is greater by 1300 kAm$^{-1}$ than that of Comparative Example 1 while a decline of remanence (Br) is only 15 mT.

TABLE 1

| | | Diffusion alloy | | | |
|---|---|---|---|---|---|
| | | | Main intermetallic | Diffusion treatment | |
| | Sintered body | Composition | compound | Temperature | Time |
| Example 1 | $Nd_{16.0}Fe_{bal}Co_{1.0}B_{5.3}$ | $Nd_{33}Al_{67}$ | $NdAl_2$ | 800° C. | 1 hr |
| Comparative Example 1 | $Nd_{16.0}Fe_{bal}Co_{1.0}B_{5.3}$ | — | — | 800° C. | 1 hr |

TABLE 2

| | Br (T) | Hcj (kAm$^{-1}$) | $(BH)_{max}$ (kJ/m$^3$) |
|---|---|---|---|
| Example 1 | 1.310 | 1970 | 332 |
| Comparative Example 1 | 1.325 | 670 | 318 |

Example 2 and Comparative Example 2

A magnet alloy was prepared by using Nd, Fe and Co metals having a purity of at least 99% by weight and ferroboron, high-frequency heating in an argon atmosphere for melting, and casting the alloy melt in a copper mold. The alloy was ground on a Brown mill into a coarse powder with a particle size of up to 1 mm.

Subsequently, the coarse powder was finely pulverized on a jet mill using high-pressure nitrogen gas into a fine powder having a mass median particle diameter of 5.2 μm. The fine powder was compacted under a pressure of about 300 kg/cm$^2$ while being oriented in a magnetic field of 1592 kAm$^{-1}$. The green compact was then placed in a vacuum sintering furnace where it was sintered at 1,060° C. for 1.5 hours, obtaining a sintered block. Using a diamond grinding tool, the sintered block was machined on all the surfaces into a shape having dimensions of 4×4×2 mm. It was washed in sequence with alkaline solution, deionized water, nitric acid and deionized water, and dried, obtaining a mother sintered body which had the composition $Nd_{16.0}Fe_{bal}Co_{1.0}B_{5.3}$.

By using Nd, Fe, Co and Al metals having a purity of at least 99% by weight and arc melting in an argon atmosphere, a diffusion alloy having the composition $Nd_{35}Fe_{25}Co_{20}Al_{20}$ was prepared. The alloy was finely pulverized on a ball mill using an organic solvent into a fine powder having a mass median particle diameter of 7.8 μm. On EPMA analysis, the alloy contained intermetallic compound phases $Nd(FeCoAl)_2$, $Nd_2(FeCoAl)$ and $Nd_2(FeCoAl)_{17}$ and the like, with the total of intermetallic compound phases being 87% by volume.

The diffusion alloy powder, 15 g, was mixed with 45 g of ethanol to form a slurry, in which the mother sintered body was immersed for 30 seconds under ultrasonic agitation. The sintered body was pulled up and immediately dried with hot air.

The sintered body covered with the diffusion alloy powder was subjected to diffusion treatment in vacuum at 800° C. for one hour, yielding a magnet of Example 2. In the absence of the powdered diffusion alloy, the sintered body alone was subjected to heat treatment in vacuum at 800° C. for one hour, yielding a magnet of Comparative Example 2.

Table 3 summarizes the composition of the mother sintered body and the diffusion alloy, the main intermetallic compounds in the diffusion alloy, the temperature and time of diffusion treatment in Example 2 and Comparative Example 2. Table 4 shows the magnetic properties of the magnets of Example 2 and Comparative Example 2. It is seen that the coercive force of the magnet of Example 2 is greater by 1150 $kAm^{-1}$ than that of Comparative Example 2 while a decline of remanence is only 18 mT.

TABLE 3

| | | Diffusion alloy | | | |
|---|---|---|---|---|---|
| | | | Main intermetallic | Diffusion treatment | |
| | Sintered body | Composition | compound | Temperature | Time |
| Example 2 | $Nd_{16.0}Fe_{bal}Co_{1.0}B_{5.3}$ | $Nd_{35}Fe_{25}Co_{20}Al_{20}$ | $Nd(FeCoAl)_2$<br>$Nd_2(FeCoAl)$<br>$Nd_2(FeCoAl)_{17}$ | 800° C. | 1 hr |
| Comparative Example 2 | $Nd_{16.0}Fe_{bal}Co_{1.0}B_{5.3}$ | — | — | 800° C. | 1 hr |

TABLE 4

| | Br (T) | Hcj ($kAm^{-1}$) | $(BH)_{max}$ ($kJ/m^3$) |
|---|---|---|---|
| Example 2 | 1.307 | 1820 | 330 |
| Comparative Example 2 | 1.325 | 670 | 318 |

Example 3

A magnet alloy was prepared by using Nd, Fe and Co metals having a purity of at least 99% by weight and ferroboron, high-frequency heating in an argon atmosphere for melting, and casting the alloy melt in a copper mold. The alloy was ground on a Brown mill into a coarse powder with a particle size of up to 1 mm.

Subsequently, the coarse powder was finely pulverized on a jet mill using high-pressure nitrogen gas into a fine powder having a mass median particle diameter of 5.2 μm. The fine powder was compacted under a pressure of about 300 $kg/cm^2$ while being oriented in a magnetic field of 1592 $kAm^{-1}$. The green compact was then placed in a vacuum sintering furnace where it was sintered at 1,060° C. for 1.5 hours, obtaining a sintered block. Using a diamond grinding tool, the sintered block was machined on all the surfaces into a shape having dimensions of 50×50×15 mm (Example 3-1) or a shape having dimensions of 50×50×25 mm (Example 3-2). It was washed in sequence with alkaline solution, deionized water, nitric acid and deionized water, and dried, obtaining a mother sintered body which had the composition $Nd_{16.0}Fe_{bal}Co_{1.0}B_{5.3}$.

By using Nd and Al metals having a purity of at least 99% by weight and arc melting in an argon atmosphere, a diffusion alloy having the composition $Nd_{33}Al_{67}$ and composed mainly of an intermetallic compound phase $NdAl_2$ was prepared. The alloy was finely pulverized on a ball mill using an organic solvent into a fine powder having a mass median particle diameter of 7.8 μm. On EPMA analysis, the alloy contained 93% by volume of the intermetallic compound phase $NdAl_2$.

The diffusion alloy powder, 30 g, was mixed with 90 g of ethanol to form a slurry, in which each mother sintered body of Examples 3-1 and 3-2 was immersed for 30 seconds under ultrasonic agitation. The sintered body was pulled up and immediately dried with hot air.

The sintered bodies covered with the diffusion alloy powder were subjected to diffusion treatment in vacuum at 850° C. for 6 hours, yielding magnets of Example 3-1 and 3-2.

Table 5 summarizes the composition of the mother sintered body and the diffusion alloy, the main intermetallic compound in the diffusion alloy, the temperature and time of diffusion treatment, and the dimension of sintered body minimum portion in Examples 3-1 and 3-2. Table 6 shows the magnetic properties of the magnets of Examples 3-1 and 3-2. It is seen that in Example 3-1 where the sintered body minimum portion had a dimension of 15 mm, the diffusion treatment exerted a greater effect as demonstrated by a coercive force of 1584 $kAm^{-1}$. In contrast, where the sintered body minimum portion had a dimension in excess of 20 mm, for example, a dimension of 25 mm in Example 3-2, the diffusion treatment exerted a less effect.

TABLE 5

| | | Diffusion alloy | | | | Sintered |
|---|---|---|---|---|---|---|
| | Sintered body | | Main intermetallic | Diffusion treatment | | body minimum |
| | composition | Composition | compound | Temperature | Time | portion |
| Example 3-1 | $Nd_{16.0}Fe_{bal}Co_{1.0}B_{5.3}$ | $Nd_{33}Al_{67}$ | $NdAl_2$ | 850° C. | 6 hr | 15 mm |
| Example 3-2 | $Nd_{16.0}Fe_{bal}Co_{1.0}B_{5.3}$ | $Nd_{33}Al_{67}$ | $NdAl_2$ | 850° C. | 6 hr | 25 mm |

TABLE 6

| | Br (T) | Hcj ($kAm^{-1}$) | $(BH)_{max}$ ($kJ/m^3$) |
|---|---|---|---|
| Example 3-1 | 1.305 | 1584 | 329 |
| Example 3-2 | 1.305 | 653 | 308 |

Examples 4 to 52

As in Example 1, various mother sintered bodies were coated with various diffusion alloys and subjected to diffusion treatment at certain temperatures for certain times. Tables 7 and 8 summarize the composition of the mother sintered body and the diffusion alloy, the type and amount of main intermetallic compound in the diffusion alloy, the temperature and time of diffusion treatment. Tables 9 and 10 show the magnetic properties of the magnets. It is noted that the amount of intermetallic compound in the diffusion alloy was determined by EPMA analysis.

TABLE 7

| | | | Diffusion alloy | | | Diffusion treatment | |
|---|---|---|---|---|---|---|---|
| | | Sintered body | Composition | Main intermetallic compound | Amount of intermetallic compound (vol %) | Temperature (° C.) | Time |
| Example | 4 | $Nd_{16.0}Fe_{bal}Co_{1.0}B_{5.4}$ | $Nd_{35}Fe_{20}Co_{15}Al_{30}$ | $Nd(FeCoAl)_2$<br>$Nd_2(FeCoAl)$ | 85 | 780 | 1 hr |
| | 5 | $Nd_{16.0}Fe_{bal}Co_{1.0}B_{5.4}$ | $Nd_{35}Fe_{25}Co_{20}Si_{20}$ | $Nd(FeCoSi)_2$<br>$Nd_2(FeCoSi)$ | 92 | 880 | 1 hr |
| | 6 | $Nd_{16.0}Fe_{bal}Co_{1.0}B_{5.4}$ | $Nd_{33}Fe_{20}Co_{27}Al_{15}Si_5$ | $Nd(FeCoAlSi)_2$<br>$Nd_2(FeCoAlSi)$ | 88 | 820 | 50 min |
| | 7 | $Nd_{11.0}Dy_{3.0}Tb_{2.0}Fe_{bal}Co_{1.0}B_{5.5}$ | $Nd_{28}Pr_5Al_{67}$ | $(NdPr)Al_2$ | 84 | 800 | 2 hr |
| | 8 | $Nd_{18.0}Fe_{bal}Co_{1.5}B_{6.2}$ | $Y_{21}Mn_{28}Cr_1$ | $Y_6(MnCr)_{23}$ | 74 | 920 | 6 hr |
| | 9 | $Nd_{13.0}Pr_{2.5}Fe_{bal}Co_{2.8}B_{4.8}$ | $La_{33}Cu_{60}Co_4Ni_3$ | $La(CuCoNi)_2$<br>$La(CuCoNi)$ | 73 | 820 | 2 hr |
| | 10 | $Nd_{13.0}Pr_{2.5}Fe_{bal}Co_{2.8}B_{4.8}$ | $La_{50}Ni_{49}V_1$ | $La(NiV)$ | 71 | 800 | 2 hr |
| | 11 | $Nd_{13.0}Dy_{2.5}Fe_{bal}Co_{1.0}B_{5.9}$ | $La_{33}Cu_{66.5}Nb_{0.5}$ | $La(CuNb)_2$ | 75 | 830 | 8 hr |
| | 12 | $Nd_{17.0}Fe_{bal}Co_{3.0}B_{4.7}$ | $Ce_{22}Ni_{14}Co_{58}Zn_6$ | $Ce_2(NiCoZn)_7$<br>$Ce(NiCoZn)_5$ | 76 | 460 | 10 hr |
| | 13 | $Nd_{17.0}Fe_{bal}Co_{3.0}B_{4.7}$ | $Ce_{17}Ni_{87}$ | $Ce_2Ni_5$ | 72 | 420 | 10 hr |
| | 14 | $Nd_{19.0}Fe_{bal}Co_{3.5}B_{6.3}$ | $Ce_{11}Zn_{89}$ | $Ce_2Zn_{17}$ | 77 | 580 | 3 hr |
| | 15 | $Nd_{17.5}Dy_{1.5}Fe_{bal}Co_{4.5}B_{5.1}$ | $Pr_{33}Ge_{67}$ | $PrGe_2$ | 84 | 860 | 40 min |
| | 16 | $Nd_{15.5}Pr_{2.5}Fe_{bal}Co_{3.5}B_{5.6}$ | $Pr_{33}Al_{66}Zr_1$ | $Pr(AlZr)_2$ | 87 | 880 | 50 min |
| | 17 | $Nd_{15.0}Tb_{1.5}Fe_{bal}B_{5.5}$ | $Gd_{32}Mn_{30}Fe_{31}Nb_7$ | $Gd(MnFeNb)_2$<br>$Gd(MnFeNb)_3$ | 87 | 980 | 3 hr |
| | 18 | $Nd_{12.0}Fe_{bal}Co_{1.0}B_{4.8}$ | $Gd_{37}Mn_{40}Co_{20}Mo_3$ | $Gd(MnCoMo)_2$<br>$Gd_6(MnCoMo)_{23}$ | 88 | 970 | 2 hr |
| | 19 | $Nd_{15.0}Tb_{1.5}Fe_{bal}B_{5.5}$ | $Gd_{21}Mn_{78}Mo_1$ | $Gd_6(MnMo)_{23}$ | 85 | 960 | 3 hr |
| | 20 | $Nd_{12.0}Fe_{bal}Co_{1.0}B_{4.8}$ | $Gd_{33}Mn_{66}Ta_1$ | $Gd(MnTa)_2$ | 86 | 940 | 2 hr |
| | 21 | $Nd_{13.0}Pr_{3.0}Fe_{bal}Co_{2.5}B_{5.2}$ | $Tb_{29}Fe_{45}Ni_{20}Ag_6$ | $Tb(FeNiAg)_2$<br>$Tb_2(FeNiAg)_{17}$ | 79 | 820 | 3 hr |
| | 22 | $Nd_{13.0}Pr_{3.0}Fe_{bal}Co_{2.5}B_{5.2}$ | $Tb_{50}Ag_{50}$ | $TbAg$ | 82 | 850 | 3 hr |
| | 23 | $Nd_{12.5}Dy_{3.0}Fe_{bal}Co_{0.7}B_{5.9}$ | $Tb_{50}In_{50}$ | $TbIn$ | 81 | 870 | 4 hr |
| | 24 | $Nd_{12.5}Pr_{2.5}Tb_{0.5}Fe_{bal}Co_{0.5}B_{5.0}$ | $Dy_{31}Ni_8Cu_{55}Sn_6$ | $Dy(NiCuSn)_2$<br>$Dy_2(NiCuSn)_7$ | 84 | 860 | 3 hr |
| | 25 | $Nd_{12.0}Pr_{2.5}Dy_{2.5}Fe_{bal}Co_{0.6}B_{5.7}$ | $Dy_{33}Cu_{66.5}Hf_{0.5}$ | $Dy(CuHf)_2$ | 86 | 940 | 2 hr |
| | 26 | $Nd_{12.8}Pr_{2.5}Tb_{0.2}Fe_{bal}Co_{1.0}B_{4.5}$ | $Er_{28}Mn_{30}Co_{35}Ta_2$ | $Er(MnCoTa)_2$<br>$Er_6(MnCoTa)_{23}$ | 78 | 1030 | 3 hr |
| | 27 | $Nd_{13.2}Pr_{3.5}Dy_{0.5}Fe_{bal}Co_{3.0}B_{6.3}$ | $Er_{21}Mn_{78.6}W_{0.4}$ | $Er_6(MnW)_{23}$ | 81 | 980 | 6 hr |
| | 28 | $Nd_{12.0}Tb_{3.5}Fe_{bal}Co_{3.5}B_{6.2}$ | $Yb_{24}Co_5Ni_{69}Bi_2$ | $Yb(CoNiBi)_3$<br>$Yb(CoNiBi)_5$ | 72 | 230 | 10 min |
| | 29 | $Nd_{12.5}Dy_{4.0}Fe_{bal}Co_{2.0}B_{4.8}$ | $Yb_{50}Cu_{49}Ti_1$ | $Yb(CuTi)$ | 73 | 280 | 5 min |
| | 30 | $Nd_{12.0}Tb_{3.5}Fe_{bal}Co_{3.5}B_{6.2}$ | $Yb_{25}Ni_{74.5}Sb_{0.5}$ | $Yb(NiSb)_3$ | 74 | 260 | 10 min |

TABLE 8

| | | Sintered body | Diffusion alloy: Composition | Diffusion alloy: Main intermetallic compound | Diffusion alloy: Amount of intermetallic compound (vol %) | Diffusion treatment: Temperature (° C.) | Diffusion treatment: Time |
|---|---|---|---|---|---|---|---|
| Example | 31 | $Nd_{16.0}Fe_{bal}Co_{1.0}B_{5.3}$ | $Nd_{33}Al_{67}$ | $NdAl_2$ | 94 | 780 | 3 hr |
| | 32 | $Nd_{16.0}Fe_{bal}Co_{1.0}B_{5.4}$ | $Nd_{50}Si_{50}$ | NdSi<br>$Nd_5Si_4$ | 92 | 940 | 4 hr |
| | 33 | $Nd_{16.0}Fe_{bal}Co_{1.0}B_{5.3}$ | $Nd_{33}Al_{37}Si_{30}$ | $Nd(AlSi)_2$ | 93 | 830 | 3 hr |
| | 34 | $Nd_{13.5}Dy_{2.0}Fe_{bal}Co_{3.5}B_{5.4}$ | $Nd_{27}Pr_6Al_{67}$ | $(NdPr)Al_2$ | 94 | 750 | 2 hr |
| | 35 | $Nd_{16.0}Fe_{bal}Co_{1.0}B_{5.3}$ | $Dy_{33}Al_{67}$ | $DyAl_2$ | 93 | 820 | 4 hr |
| | 36 | $Nd_{14.0}Tb_{1.5}Fe_{bal}Co_{3.5}B_{5.2}$ | $Dy_{33}Ga_{67}$ | $DyGa_2$ | 91 | 780 | 40 min |
| | 37 | $Nd_{16.0}Fe_{bal}Co_{1.0}B_{5.3}$ | $Tb_{33}Al_{67}$ | $TbAl_2$ | 93 | 840 | 3 hr |
| | 38 | $Nd_{13.5}Pr_{2.5}Dy_{2.0}Fe_{bal}Co_{2.5}B_{5.3}$ | $Tb_{22}Mn_{78}$ | $Tb_6Mn_{23}$<br>$TbMn_2$ | 87 | 640 | 10 hr |
| | 39 | $Nd_{20.0}Fe_{bal}Co_{3.0}B_{5.4}$ | $Y_{10}Co_{15}Zn_{75}$ | $Y_2(CoZn)_{17}$<br>$Y(CoZn)_5$ | 75 | 450 | 5 hr |
| | 40 | $Nd_{18.0}Fe_{bal}Co_{2.5}B_{6.6}$ | $Y_{68}Fe_2In_{30}$ | $Y_2(FeIn)$<br>$Y_5(FeIn)_3$ | 72 | 1020 | 30 min |
| | 41 | $Nd_{20.0}Fe_{bal}Co_{3.0}B_{5.4}$ | $Y_{11}Zn_{89}$ | $Y_2Zn_{17}$ | 73 | 420 | 5 hr |
| | 42 | $Nd_{13.5}Pr_{1.5}Dy_{0.8}Fe_{bal}Co_{2.5}B_{4.5}$ | $La_{32}Co_4Cu_{64}$ | $La(CoCu)_2$<br>$La(CoCu)_5$ | 81 | 670 | 4 hr |
| | 43 | $Nd_{13.5}Pr_{1.5}Dy_{0.5}Fe_{bal}Co_{2.5}B_{4.5}$ | $La_{33}Cu_{67}$ | $LaCu_2$ | 79 | 630 | 4 hr |
| | 44 | $Nd_{20.0}Fe_{bal}Co_{5.5}B_{4.1}$ | $Ce_{26}Pb_{74}$ | $CePb_3$ | 76 | 520 | 3 hr |
| | 45 | $Nd_{15.2}Fe_{bal}Co_{3.5}B_{6.9}$ | $Ce_{56}Sn_{44}$ | $Ce_5Sn_4$ | 78 | 480 | 6 hr |
| | 46 | $Nd_{15.5}Dy_{2.5}Tb_{0.5}Fe_{bal}Co_{2.6}B_{4.4}$ | $Pr_{33}Fe_3C_{64}$ | $PrC_2$ | 73 | 830 | 30 hr |
| | 47 | $Nd_{12.5}Dy_{2.5}Tb_{0.5}Fe_{bal}Co_{3.8}B_{6.2}$ | $Pr_{50}P_{50}$ | PrP | 70 | 350 | 20 min |
| | 48 | $Nd_{14.8}Pr_{1.8}Dy_{0.6}Fe_{bal}Co_{1.4}B_{5.6}$ | $Gd_{52}Ni_{48}$ | GdNi | 82 | 980 | 30 min |
| | 49 | $Nd_{13.6}Pr_{1.5}Tb_{0.5}Fe_{bal}Co_{2.8}B_{6.3}$ | $Gd_{37}Ga_{63}$ | $GdGa_2$ | 76 | 870 | 20 min |
| | 50 | $Nd_{16.0}Dy_{0.6}Fe_{bal}Co_{1.0}B_{4.9}$ | $Er_{32}Mn_{67}Ta_1$ | $Er(MnTa)_2$<br>$Er_6(MnTa)_{23}$ | 76 | 680 | 6 hr |
| | 51 | $Nd_{14.5}Pr_{1.5}Dy_{0.5}Fe_{bal}Co_{2.8}B_{4.6}$ | $Yb_{68}Pb_{32}$ | $Yb_2Pb$ | 73 | 750 | 5 hr |
| | 52 | $Nd_{12.0}Pr_{1.5}Dy_{0.5}Fe_{bal}Co_{4.2}B_{5.8}$ | $Yb_{69}Sn_{29}Bi_2$ | $Yb_2(SnBi)$<br>$Yb_5(SnBi)_3$ | 71 | 420 | 4 hr |

TABLE 9

| | Br (T) | Hcj ($kAm^{-1}$) | $(BH)_{max}$ ($kJ/m^3$) |
|---|---|---|---|
| Example 4 | 1.300 | 1871 | 327 |
| Example 5 | 1.315 | 1831 | 333 |
| Example 6 | 1.310 | 1879 | 331 |
| Example 7 | 1.305 | 1966 | 329 |
| Example 8 | 1.240 | 844 | 286 |
| Example 9 | 1.260 | 1059 | 297 |
| Example 10 | 1.280 | 892 | 304 |
| Example 11 | 1.335 | 1059 | 339 |
| Example 12 | 1.252 | 756 | 292 |
| Example 13 | 1.245 | 780 | 288 |
| Example 14 | 1.225 | 892 | 283 |
| Example 15 | 1.220 | 1855 | 282 |
| Example 16 | 1.265 | 1887 | 305 |
| Example 17 | 1.306 | 1528 | 318 |
| Example 18 | 1.351 | 1250 | 341 |
| Example 19 | 1.305 | 1457 | 323 |
| Example 20 | 1.348 | 1297 | 338 |
| Example 21 | 1.311 | 1520 | 322 |
| Example 22 | 1.308 | 1719 | 326 |
| Example 23 | 1.298 | 1767 | 322 |
| Example 24 | 1.304 | 1695 | 316 |
| Example 25 | 1.306 | 1703 | 325 |
| Example 26 | 1.273 | 1306 | 304 |
| Example 27 | 1.265 | 1361 | 305 |
| Example 28 | 1.292 | 1106 | 312 |
| Example 29 | 1.254 | 1258 | 291 |
| Example 30 | 1.325 | 1083 | 332 |

TABLE 10

| | Br (T) | Hcj ($kAm^{-1}$) | $(BH)_{max}$ ($kJ/m^3$) |
|---|---|---|---|
| Example 31 | 1.300 | 1910 | 324 |
| Example 32 | 1.315 | 1871 | 329 |
| Example 33 | 1.310 | 1934 | 328 |

TABLE 10-continued

| | Br (T) | Hcj ($kAm^{-1}$) | $(BH)_{max}$ ($kJ/m^3$) |
|---|---|---|---|
| Example 34 | 1.318 | 1958 | 330 |
| Example 35 | 1.305 | 1966 | 326 |
| Example 36 | 1.314 | 1974 | 328 |
| Example 37 | 1.311 | 2006 | 330 |
| Example 38 | 1.263 | 1528 | 297 |
| Example 39 | 1.220 | 1130 | 269 |
| Example 40 | 1.180 | 1186 | 251 |
| Example 41 | 1.235 | 1051 | 278 |
| Example 42 | 1.245 | 1146 | 289 |
| Example 43 | 1.242 | 1154 | 286 |
| Example 44 | 1.104 | 971 | 221 |
| Example 45 | 1.262 | 1043 | 293 |
| Example 46 | 1.173 | 1098 | 255 |
| Example 47 | 1.307 | 971 | 311 |
| Example 48 | 1.285 | 1178 | 309 |
| Example 49 | 1.311 | 1226 | 325 |
| Example 50 | 1.268 | 939 | 298 |
| Example 51 | 1.252 | 1003 | 290 |
| Example 52 | 1.352 | 860 | 341 |

Example 53

A magnet alloy was prepared by using Nd, Fe and Co metals having a purity of at least 99% by weight and ferroboron, high-frequency heating in an argon atmosphere for melting, and casting the alloy melt in a copper mold. The alloy was ground on a Brown mill into a coarse powder with a particle size of up to 1 mm.

Subsequently, the coarse powder was finely pulverized on a jet mill using high-pressure nitrogen gas into a fine powder having a mass median particle diameter of 5.2 μm. The fine powder was compacted under a pressure of about 300 kg/cm$^2$ while being oriented in a magnetic field of 1592 kAm$^{-1}$. The green compact was then placed in a vacuum sintering furnace where it was sintered at 1,060° C. for 1.5 hours, obtaining a sintered block. Using a diamond grinding tool, the sintered block was machined on all the surfaces into a shape having dimensions of 4×4×2 mm. It was washed in sequence with alkaline solution, deionized water, nitric acid and deionized water, and dried, obtaining a mother sintered body which had the composition $Nd_{16.0}Fe_{bal}Co_{1.0}B_{5.3}$.

By using Al and Co metals having a purity of at least 99% by weight and arc melting in an argon atmosphere, a diffusion alloy having the composition $Al_{50}Co_{50}$ (in atom %) and composed mainly of an intermetallic compound phase AlCo was prepared. The alloy was finely pulverized on a ball mill using an organic solvent into a fine powder having a mass median particle diameter of 8.5 μm. On EPMA analysis, the alloy contained 93% by volume of the intermetallic compound phase AlCo.

The diffusion alloy powder, 15 g, was mixed with 45 g of ethanol to form a slurry, in which the mother sintered body was immersed for 30 seconds under ultrasonic agitation. The sintered body was pulled up and immediately dried with hot air.

The sintered body covered with the diffusion alloy powder was subjected to diffusion treatment in vacuum at 800° C. for one hour, yielding a magnet of Example 53.

Table 11 summarizes the composition of the mother sintered body and the diffusion alloy, the main intermetallic compound in the diffusion alloy, the temperature and time of diffusion treatment in Example 53. Table 12 shows the magnetic properties of the magnet of Example 53. It is seen that the coercive force of the magnet of Example 53 is greater by 1170 kAm$^{-1}$ than that of the preceding Comparative Example 1 while a decline of remanence is only 20 mT.

TABLE 11

| | | Diffusion alloy | | Diffusion treatment | |
|---|---|---|---|---|---|
| | Sintered body | Composition | Intermetallic compound | Temperature | Time |
| Example 53 | $Nd_{16.0}Fe_{bal}Co_{1.0}B_{5.3}$ | $Al_{50}CO_{50}$ | AlCo | 800° C. | 1 hr |

TABLE 12

| | Br (T) | Hcj (kAm$^{-1}$) | $(BH)_{max}$ (kJ/m$^3$) |
|---|---|---|---|
| Example 53 | 1.305 | 1840 | 329 |

Example 54 and Comparative Example 3

A magnet alloy was prepared by using Nd, Fe and Co metals having a purity of at least 99% by weight and ferroboron, high-frequency heating in an argon atmosphere for melting, and casting the alloy melt in a copper mold. The alloy was ground on a Brown mill into a coarse powder with a particle size of up to 1 mm.

Subsequently, the coarse powder was finely pulverized on a jet mill using high-pressure nitrogen gas into a fine powder having a mass median particle diameter of 5.2 μm. The fine powder was compacted under a pressure of about 300 kg/cm$^2$ while being oriented in a magnetic field of 1592 kAm$^{-1}$. The green compact was then placed in a vacuum sintering furnace where it was sintered at 1,060° C. for 1.5 hours, obtaining a sintered block. Using a diamond grinding tool, the sintered block was machined on all the surfaces into a shape having dimensions of 50×50×15 mm (Example 54) or a shape having dimensions of 50×50×25 mm (Comparative Example 3). It was washed in sequence with alkaline solution, deionized water, nitric acid and deionized water, and dried, obtaining a mother sintered body which had the composition $Nd_{16.0}Fe_{bal}Co_{1.0}B_{5.3}$.

By using Al and Co metals having a purity of at least 99% by weight and arc melting in an argon atmosphere, a diffusion alloy having the composition $Al_{50}Co_{50}$ (in atom %) and composed mainly of an intermetallic compound phase AlCo was prepared. The alloy was finely pulverized on a ball mill using an organic solvent into a fine powder having a mass median particle diameter of 8.5 μm. On EPMA analysis, the alloy contained 92% by volume of the intermetallic compound phase AlCo.

The diffusion alloy powder, 30 g, was mixed with 90 g of ethanol to form a slurry, in which each mother sintered body of Example 54 and Comparative Example 3 was immersed for 30 seconds under ultrasonic agitation. The sintered body was pulled up and immediately dried with hot air.

The sintered bodies covered with the diffusion alloy powder were subjected to diffusion treatment in vacuum at 850° C. for 6 hours, yielding magnets of Example 54 and Comparative Example 3.

Table 13 summarizes the composition of the mother sintered body and the diffusion alloy, the main intermetallic compound in the diffusion alloy, the temperature and time of diffusion treatment, and the dimension of sintered body minimum portion in Example 54 and Comparative Example 3. Table 14 shows the magnetic properties of the magnets of Example 54 and Comparative Example 3. It is seen that in Example 54 where the sintered body minimum portion had a dimension of 15 mm, the diffusion treatment exerted a greater effect as demonstrated by a coercive force of 1504 kAm$^{-1}$. In contrast, where the sintered body minimum portion had a dimension in excess of 20 mm, for example, a dimension of 25 mm in Comparative Example 3, the diffusion treatment exerted little effect as demonstrated by little increase of coercive force.

TABLE 13

| | Sintered body composition | Diffusion alloy Composition | Diffusion alloy Intermetallic compound | Diffusion treatment Temperature | Diffusion treatment Time | Sintered body minimum portion |
|---|---|---|---|---|---|---|
| Example 54 | $Nd_{16.0}Fe_{bal}Co_{1.0}B_{5.3}$ | $Al_{50}Co_{50}$ | AlCo | 850° C. | 6 hr | 15 mm |
| Comparative Example 3 | $Nd_{16.0}Fe_{bal}Co_{1.0}B_{5.3}$ | $Al_{50}Co_{50}$ | AlCo | 850° C. | 6 hr | 25 mm |

TABLE 14

| | Br (T) | Hcj ($kAm^{-1}$) | $(BH)_{max}$ ($kJ/m^3$) |
|---|---|---|---|
| Example 54 | 1.306 | 1504 | 328 |
| Comparative Example 3 | 1.306 | 710 | 309 |

Examples 55 to 84

As in Example 53, various mother sintered bodies were coated with various diffusion alloy powder and subjected to diffusion treatment at certain temperatures for certain times. Table 15 summarizes the composition of the mother sintered body and the diffusion alloy, the type and amount of main intermetallic compound phase in the diffusion alloy, the temperature and time of diffusion treatment. Table 16 shows the magnetic properties of the magnets. It is noted that the amount of intermetallic compound phase in the diffusion alloy was determined by EPMA analysis.

TABLE 15

| | | Diffusion alloy | | | Diffusion treatment | |
|---|---|---|---|---|---|---|
| | Sintered body | Composition | Intermetallic compound | Amount of intermetallic compound (vol %) | Temperature (° C.) | Time |
| Example 55 | $Nd_{16.0}Fe_{bal}Co_{1.0}B_{5.4}$ | $Mn_{27}Al_{73}$ | $Al_{11}Mn_4$ | 95 | 770 | 1 hr |
| 56 | $Nd_{13.0}Pr_{3.0}Fe_{bal}Co_{3.0}B_{5.2}$ | $Ni_{25}Al_{75}$ | $NiAl_3$ | 93 | 780 | 50 min |
| 57 | $Nd_{15.3}Dy_{1.2}Fe_{bal}Co_{2.0}B_{5.3}$ | $Cr_{12.5}Al_{87.5}$ | $Al_7Cr$ | 91 | 750 | 45 min |
| 58 | $Nd_{15.0}Tb_{0.7}Fe_{bal}Co_{1.0}B_{5.5}$ | $Co_{33}Si_{67}$ | $CoSi_2$ | 94 | 840 | 2 hr |
| 59 | $Nd_{17.0}Fe_{bal}Co_{1.5}B_{5.3}$ | $Mn_{25}Al_{25}Cu_{50}$ | $Cu_2MnAl$ | 87 | 750 | 3 hr |
| 60 | $Nd_{15.2}Dy_{0.8}Tb_{0.3}Fe_{bal}Co_{1.0}B_{5.4}$ | $Fe_{50}Si_{50}$ | FeSi | 92 | 870 | 4 hr |
| 61 | $Nd_{20.0}Fe_{bal}Co_{4.0}B_{5.3}$ | $Fe_{49.9}C_{0.1}Si_{50}$ | FeSi | 86 | 920 | 10 hr |
| 62 | $Nd_{18.0}Fe_{bal}Co_{3.5}B_{4.2}$ | $Ti_{50}C_{50}$ | TiC | 85 | 1040 | 28 hr |
| 63 | $Nd_{16.0}Fe_{bal}Co_{1.0}B_{6.8}$ | $Mn_{67}P_{33}$ | $Mn_2P$ | 71 | 350 | 5 min |
| 64 | $Nd_{12.0}Fe_{bal}Co_{2.0}B_{6.0}$ | $Ti_{50}Cu_{50}$ | TiCu | 82 | 640 | 5 hr |
| 65 | $Nd_{16.0}Fe_{bal}Co_{1.0}B_{5.5}$ | $V_{75}Sn_{25}$ | $V_3Sn$ | 79 | 920 | 2 hr |
| 66 | $Nd_{16.0}Fe_{bal}B_{6.1}$ | $Cr_{67}Ta_{33}$ | $Cr_2Ta$ | 76 | 980 | 5 hr |
| 67 | $Nd_{15.5}Fe_{bal}Co_{3.0}B_{5.4}$ | $Cu_{75}Sn_{25}$ | $Cu_3Sn$ | 84 | 580 | 3 hr |
| 68 | $Pr_{16.0}Fe_{bal}Co_{6.5}B_{5.3}$ | $Cu_{70}Zn_5Sn_{25}$ | $(Cu,Zn)_3Sn$ | 73 | 520 | 5 hr |
| 69 | $Nd_{17.0}Pr_{1.5}Fe_{bal}Co_{2.5}B_{5.2}$ | $Ga_{40}Zr_{60}$ | $Ga_2Zr_3$ | 83 | 800 | 2 hr |
| 70 | $Nd_{16.0}Fe_{bal}Co_{3.0}B_{5.3}$ | $Cr_{75}Ge_{25}$ | $Cr_3Ge$ | 84 | 820 | 4 hr |
| 71 | $Nd_{14.6}Pr_{3.0}Dy_{0.8}Fe_{bal}Co_{2.0}B_{5.3}$ | $Nb_{33}Si_{67}$ | $NbSi_2$ | 89 | 950 | 5 hr |
| 72 | $Pr_{14.6}Dy_{1.0}Fe_{bal}Co_{1.0}B_{5.4}$ | $Al_{73}Mo_{27}$ | $Al_8Mo_3$ | 86 | 780 | 50 min |
| 73 | $Nd_{16.0}Fe_{bal}Co_{1.0}B_{6.4}$ | $Ti_{50}Ag_{50}$ | TiAg | 85 | 740 | 2 hr |
| 74 | $Nd_{15.2}Fe_{bal}Co_{1.0}B_{5.3}$ | $In_{25}Mn_{75}$ | $InMn_3$ | 75 | 570 | 8 hr |
| 75 | $Nd_{15.4}Fe_{bal}B_{5.6}$ | $Hf_{33}Cr_{67}$ | $HfCr_2$ | 85 | 940 | 4 hr |
| 76 | $Nd_{16.3}Fe_{bal}Co_{1.0}B_{5.6}$ | $Cr_{20}Fe_{55}W_{20}$ | $Cr_5Fe_{11}W_4$ | 74 | 830 | 8 hr |
| 77 | $Nd_{15.6}Yb_{0.2}Fe_{bal}Co_{1.0}B_{4.8}$ | $Ni_{50}Sb_{50}$ | NiSb | 78 | 680 | 2 hr |
| 78 | $Nd_{16.4}Fe_{bal}Co_{5.0}B_{6.9}$ | $Ti_{80}Pb_{20}$ | $Ti_4Pb$ | 79 | 710 | 3 hr |
| 79 | $Nd_{15.5}Fe_{bal}Co_{1.0}B_{5.3}$ | $Mn_{25}Co_{50}Sn_{25}$ | $Co_2MnSn$ | 77 | 650 | 6 hr |
| 80 | $Nd_{16.2}Fe_{bal}Co_{0.7}B_{5.3}$ | $Co_{60}Sn_{40}$ | $Co_3Sn_2$ | 78 | 870 | 30 min |
| 81 | $Nd_{15.7}Fe_{bal}Co_{1.5}B_{5.5}$ | $V_{75}Sn_{25}$ | $V_3Sn$ | 82 | 970 | 6 hr |
| 82 | $Nd_{14.5}Fe_{bal}Co_{0.5}B_{5.6}$ | $Cr_{21}Fe_{62}Mo_{17}$ | $Cr_6Fe_{18}Mo_5$ | 73 | 850 | 10 hr |
| 83 | $Nd_{15.0}Dy_{0.6}Fe_{bal}Co_{0.1}B_{4.1}$ | $Bi_{40}Zr_{60}$ | $Bi_2Zr_3$ | 78 | 440 | 15 hr |
| 84 | $Nd_{16.6}Fe_{bal}Co_{3.5}B_{6.4}$ | $Ni_{50}Bi_{50}$ | NiBi | 70 | 210 | 1 min |

TABLE 16

| | Br (T) | Hcj ($kAm^{-1}$) | $(BH)_{max}$ ($kJ/m^3$) |
|---|---|---|---|
| Example 55 | 1.303 | 1815 | 327 |
| Example 56 | 1.295 | 1847 | 320 |
| Example 57 | 1.290 | 1982 | 319 |
| Example 58 | 1.315 | 1902 | 334 |
| Example 59 | 1.282 | 1688 | 310 |
| Example 60 | 1.297 | 1815 | 324 |
| Example 61 | 1.190 | 1664 | 268 |
| Example 62 | 1.173 | 1258 | 260 |
| Example 63 | 1.246 | 1186 | 290 |
| Example 64 | 1.370 | 1473 | 350 |

TABLE 16-continued

| | Br (T) | Hcj ($kAm^{-1}$) | $(BH)_{max}$ ($kJ/m^3$) |
|---|---|---|---|
| Example 65 | 1.305 | 1528 | 327 |
| Example 66 | 1.313 | 1401 | 329 |
| Example 67 | 1.312 | 1656 | 325 |
| Example 68 | 1.296 | 1449 | 317 |
| Example 69 | 1.236 | 1640 | 288 |
| Example 70 | 1.312 | 1576 | 330 |
| Example 71 | 1.247 | 1656 | 295 |
| Example 72 | 1.309 | 1775 | 320 |
| Example 73 | 1.295 | 1369 | 323 |
| Example 74 | 1.335 | 1290 | 340 |
| Example 75 | 1.331 | 1242 | 337 |
| Example 76 | 1.301 | 1178 | 322 |
| Example 77 | 1.263 | 1297 | 295 |
| Example 78 | 1.258 | 1098 | 292 |
| Example 79 | 1.314 | 1616 | 330 |
| Example 80 | 1.303 | 1703 | 322 |
| Example 81 | 1.311 | 1560 | 326 |
| Example 82 | 1.342 | 1210 | 342 |
| Example 83 | 1.227 | 1043 | 280 |
| Example 84 | 1.290 | 971 | 314 |

Examples 85 to 92 and Comparative Example 4

A magnet alloy was prepared by using Nd, Fe and Co metals having a purity of at least 99% by weight and ferroboron, high-frequency heating in an argon atmosphere for melting, and casting the alloy melt in a copper mold. The alloy was ground on a Brown mill into a coarse powder with a particle size of up to 1 mm.

Subsequently, the coarse powder was finely pulverized on a jet mill using high-pressure nitrogen gas into a fine powder having a mass median particle diameter of 4.2 μm. The atmosphere was changes to an inert gas so that the oxidation of the fine powder is inhibited. Then, the fine powder was compacted under a pressure of about 300 kg/cm$^2$ while being oriented in a magnetic field of 1592 kAm$^{-1}$. The green compact was then placed in a vacuum sintering furnace where it was sintered at 1,060° C. for 1.5 hours, obtaining a sintered block. Using a diamond grinding tool, the sintered block was machined on all the surfaces into a shape having dimensions of 4×4×2 mm. It was washed in sequence with alkaline solution, deionized water, nitric acid and deionized water, and dried, obtaining a mother sintered body which had the composition $Nd_{13.8}Fe_{bal}Co_{1.0}B_{6.0}$.

By using Dy, Tb, Nd, Pr, Co, Ni and Al metals having a purity of at least 99% by weight and arc melting in an argon atmosphere, diffusion alloys having various compositions (in atom %) as shown in Table 17 were prepared. Each alloy was finely pulverized on a ball mill using an organic solvent into a fine powder having a mass median particle diameter of 7.9 μm. On EPMA analysis, each alloy contained 94% by volume of the intermetallic compound phase shown in Table 17.

The diffusion alloy powder, 15 g, was mixed with 45 g of ethanol to form a slurry, in which each mother sintered body was immersed for 30 seconds under ultrasonic agitation. The sintered body was pulled up and immediately dried with hot air.

The sintered bodies covered with the diffusion alloy powder were subjected to diffusion treatment in vacuum at 840° C. for 10 hours, yielding magnets of Examples 85 to 92. A magnet of Comparative Example 4 was also obtained by repeating the above procedure except the diffusion alloy powder was not used.

Table 17 summarizes the composition of the mother sintered body and the diffusion alloy, the main intermetallic compound in the diffusion alloy, and the temperature and time of diffusion treatment in Examples 85 to 92 and Comparative Example 4. Table 18 shows the magnetic properties of the magnets of Examples 85 to 92 and Comparative Example 4. It is seen that the coercive force of the magnets of Examples 85 to 92 is considerably greater than that of Comparative Example 4, while a decline of remanence is only about 10 mT.

TABLE 17

| | Sintered body composition | Diffusion alloy Composition | Diffusion alloy Intermetallic compound | Diffusion treatment Temperature | Diffusion treatment Time |
|---|---|---|---|---|---|
| Example 85 | $Nd_{13.8}Fe_{bal}Co_{1.0}B_{6.0}$ | $Dy_{34}Co_{33}Al_{33}$ | $Dy(CoAl)_2$ | 840° C. | 10 hr |
| Example 86 | $Nd_{13.8}Fe_{bal}Co_{1.0}B_{6.0}$ | $Dy_{34}Ni_{33}Al_{33}$ | $Dy(NiAl)_2$ | 840° C. | 10 hr |
| Example 87 | $Nd_{13.8}Fe_{bal}Co_{1.0}B_{6.0}$ | $Tb_{33}Co_{50}Al_{17}$ | $Tb(CoAl)_2$ | 840° C. | 10 hr |
| Example 88 | $Nd_{13.8}Fe_{bal}Co_{1.0}B_{6.0}$ | $Tb_{33}Ni_{17}Al_{50}$ | $Tb(NiAl)_2$ | 840° C. | 10 hr |
| Example 89 | $Nd_{13.8}Fe_{bal}Co_{1.0}B_{6.0}$ | $Nd_{34}Co_{33}Al_{33}$ | $Nd(CoAl)_2$ | 840° C. | 10 hr |
| Example 90 | $Nd_{13.8}Fe_{bal}Co_{1.0}B_{6.0}$ | $Nd_{34}Ni_{33}Al_{33}$ | $Nd(NiAl)_2$ | 840° C. | 10 hr |
| Example 91 | $Nd_{13.8}Fe_{bal}Co_{1.0}B_{6.0}$ | $Pr_{33}Co_{17}Al_{50}$ | $Pr(CoAl)_2$ | 840° C. | 10 hr |
| Example 92 | $Nd_{13.8}Fe_{bal}Co_{1.0}B_{6.0}$ | $Pr_{33}Ni_{50}Al_{17}$ | $Pr(NiAl)_2$ | 840° C. | 10 hr |
| Comparative Example 4 | $Nd_{13.8}Fe_{bal}Co_{1.0}B_{6.0}$ | — | — | 840° C. | 10 hr |

TABLE 18

| | Br (T) | Hcj (kAm$^{-1}$) | $(BH)_{max}$ (kJ/m$^3$) |
|---|---|---|---|
| Example 85 | 1.411 | 1720 | 386 |
| Example 86 | 1.409 | 1740 | 384 |
| Example 87 | 1.412 | 1880 | 388 |
| Example 88 | 1.410 | 1890 | 385 |
| Example 89 | 1.414 | 1570 | 387 |
| Example 90 | 1.413 | 1580 | 386 |
| Example 91 | 1.409 | 1640 | 384 |
| Example 92 | 1.408 | 1660 | 382 |
| Comparative Example 4 | 1.422 | 890 | 377 |

Japanese Patent Application Nos. 2007-068803 and 2007-068823 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth permanent magnet, comprising the steps of:

disposing an alloy powder having an average particle size of up to 500 μm on a surface of an original sintered body of the composition $R_a$-$T^1{}_b$-$B_c$ wherein R is at least one element selected from rare earth elements inclusive of Y and Sc, $T^1$ is at least one element selected from Fe and Co, B is boron, "a," "b" and "c" indicative of atomic percent are in the range: $12 \leqq a \leqq 20$, $4.0 \leqq c \leqq 7.0$, and the balance of b, said alloy powder having the composition $R^1{}_x T^2{}_y M^1{}_z$ wherein $R^1$ is at least one element selected from rare earth elements inclusive of Y and Sc, $T^2$ is at least one element selected from Fe and Co, $M^1$ is at least one element selected from the group consisting of Al, Si, C, P, Ti, V, Cr, Mn, Ni, Cu, Zn, Ga, Ge, Zr, Nb, Mo, Ag, In, Sn, Sb, Hf, Ta, W, Pb, and Bi, x, y and z indicative of atomic percent are in the range: $5 \leqq x \leqq 85$, $15 < z \leqq 95$, and the balance is y being greater than 0, and containing at least 70% by volume of an intermetallic compound phase, and heat treating the sintered body having the alloy powder disposed on its surface at a temperature equal to or below the sintering temperature of the original sintered body in vacuum or in an inert gas, for causing at least one element of $R^1$ and at least one element of $M^1$ in the powder to diffuse to grain boundaries in the interior of the sintered body and/or near grain boundaries within sintered body primary phase grains, said disposing step includes grinding an alloy having the composition $R^1_xT^2_yM^1_z$ wherein $R^1$, $T^2$, $M^1$, x, y and z are as defined above and containing at least 70% by volume of an intermetallic compound phase into a powder having an average particle size of up to 500 μm, dispersing the powder in an organic solvent or water, applying the resulting slurry to the surface of the sintered body, and drying.

2. The method of claim 1 wherein the heat treating step includes heat treatment at a temperature from 200° C. to (Ts-10)° C. for 1 minute to 30 hours wherein Ts represents the sintering temperature of the sintered body.

3. The method of claim 1 wherein the sintered body has a shape including a minimum portion with a dimension equal to or less than 20 mm.

4. The method of claim 1, wherein the at least one element of $R^1$ and the at least one element of $M^1$ in the powder is diffused to grain boundaries in the interior of the sintered body and near grain boundaries within sintered body primary phase grains.

5. The method of claim 1, wherein a majority of the element composition of the R is Nd and/or Pr.

6. The method of claim 1, further comprises machining the original sintered body prior to the disposing step.

7. The method of claim 1, wherein the atomic percent of y is 0.5 to 75.

8. The method of claim 1, wherein the intermetallic compound phase is at least 90% by volume.

* * * * *